United States Patent [19]

Seidel

[11] 4,033,322

[45] July 5, 1977

[54] OVEN DOOR STRUCTURE

[75] Inventor: Harry W. Seidel, Mertztown, Pa.

[73] Assignee: Raytheon Company, Lexington, Mass.

[22] Filed: Jan. 5, 1976

[21] Appl. No.: 647,260

[52] U.S. Cl. ..... 126/200; 52/304

[51] Int. Cl.[2] ..... F23M 7/00; F24C 15/04

[58] Field of Search ..... 126/200, 198; 52/304, 52/616

[56] References Cited

UNITED STATES PATENTS

| | | | |
|---|---|---|---|
| 2,536,956 | 1/1951 | Reeves | 126/200 |
| 2,580,957 | 1/1952 | Reeves | 126/200 |
| 2,587,527 | 2/1952 | Reeves | 126/200 |
| 3,384,072 | 5/1968 | Davis et al. | 126/200 |
| 3,828,763 | 8/1974 | Wilson | 126/200 |
| 3,877,460 | 4/1975 | Lotz et al. | 126/200 |

FOREIGN PATENTS OR APPLICATIONS

| | | | |
|---|---|---|---|
| 451,702 | 8/1936 | United Kingdom | 126/200 |

*Primary Examiner*—Irwin C. Cohen

*Attorney, Agent, or Firm*—Harold A. Murphy; Joseph D. Pannone; John T. Meaney

[57] ABSTRACT

A windowed door structure for an oven such as used for household baking and broiling functions, for example, which door structure assumes relatively low exterior surface temperatures during operation of the oven by virtue of the fact that the window overlies the window opening and is spaced from the front panel of the door around the window opening so as to provide a substantially dead air space between the window and the spaced underlying panel and rear window.

6 Claims, 3 Drawing Figures

OVEN DOOR STRUCTURE

BACKGROUND OF THE INVENTION

In conventional ovens used in the household for conventional baking and broiling purposes such ovens are normally built into a gas-fueled or electric range or a part of a built-in wall installation. During the operation of such ovens it has been found that exterior surfaces of the oven often assume relatively high temperatures. Such heated surfaces are often hot enough to cause severe burns to a person who comes into contact with them accidentally or otherwise. This is particularly true in the area of the oven door which sometimes must be opened for the testing of foods, for example, during operation of the oven.

Attempts have been made to reduce such door temperatures by providing the door with an air wash. The door was provided with a window having two spaced panes of glass, one supported by each of the inner and outer panels. The door was provided with apertures at its lower and upper edges which communicated with the space between the panes. When heat from the oven passed through the inner pane into the space between the panes it heated the air in this space, causing it to move upwardly and drawing cooler air in through the lower apertures. The hot air passing out the apertures in the upper edge of the door, however, engaged exposed oven or range surfaces above the door causing them to become excessively and undesirably heated. Also, such an air wash through the space between the panes created deposits on the inner surfaces of the panes, producing an objectionable film on these surfaces.

SUMMARY OF THE INVENTION

The above and other objections are overcome in the present invention by a novel door and window construction which provides considerably lower temperatures on the exterior door surfaces without requiring the objectionable air wash for the interior surfaces of the window panes. This is achieved by the provision of a door having the usual window opening extending through it and a pane of glass in its rear panel. The front panel is recessed around the window opening with the recess extending over a substantial portion of the door especially in the area above the window opening. A front or outer panel is disposed over the window also extends over the complete recessed area so as to produce an enlarged air space between the window pane and front panel throughout the entire recessed area.

Further, the front pane is supported by an encircling trim strip which is structured to support the window still farther outwardly from the front panel and to thereby considerably increase the volume of the air space. The trim also serves to seal the front pane to the front panel and thus prevents escape of heated air over the exterior surface of the door.

It has been found that by thus increasing the volume of the so-called "dead" air space, the exterior surfaces of the door and adjacent portions of the appliance are maintained at safely low temperature levels during normal operation of the oven. For example, with an oven operating at a temperature of about 400° F for about one hour the exterior surfaces of the door will be maintained at temperatures not exceeding about 165° F, which temperatures are safe. Also, since no air wash is provided, the temperatures of adjacent exterior parts of the oven or range will thus not become objectionably heated.

BRIEF DESCRIPTION OF THE DRAWINGS

The above and other objectives and advantages of the invention will become apparent from the following description taken in conection with the accompanying drawings, wherein.

DESCRIPTION OF THE PREFERRED EMBODIMENTS

Referring more particularly to the drawings wherein like characters of reference designate like parts throughout the several views, the invention is illustrated as embodied in the door 10 of an oven 12 in a free-standing kitchen range 14. It is to be understood, however, that the oven may be employed in other manners such as by being built directly into a wall or by being separately mounted at the top of a range above the conventional cooktop. The oven may be heated in any known manner such as by electric elements or by gas- or oil-fueled burners. Such heating devices are diagrammatically indicated at 16 in FIG. 2 and are adapted to be connected to an external source of fuel or energy by lines 18. Since this invention pertains to the door of such an oven, additional details of the oven, heating elements and range are not provided here.

Figure 1:
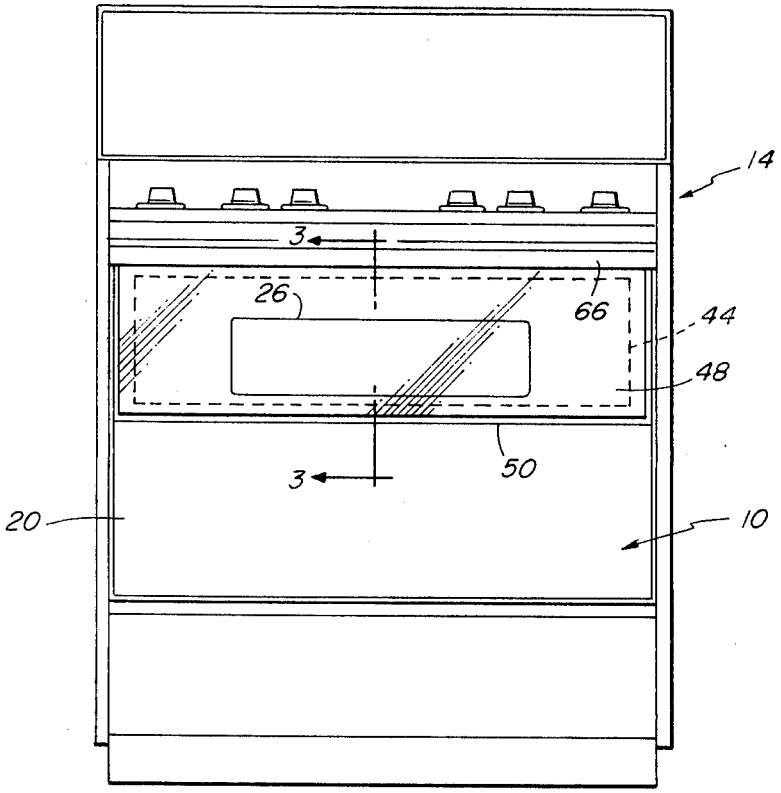
FIG. 1 is a front elevational view of a kitchen range with an oven having a door structure embodying the invention.
Figure 2:
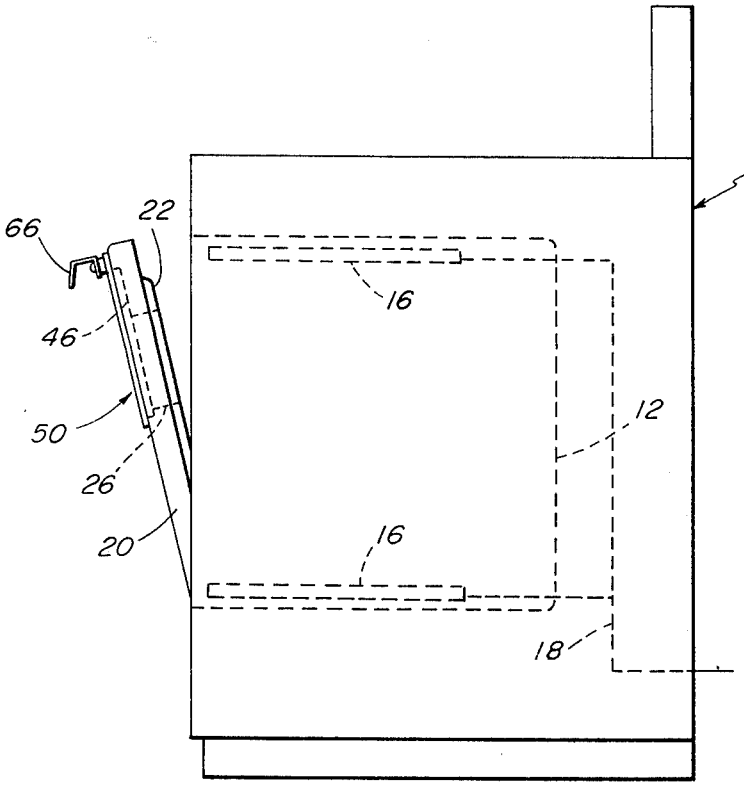
FIG. 2 is a side elevational view of the range shown in FIG. 1.

As seen in FIG. 2 the oven comprises a cavity which has an open front end adapted to be closed by a door 10 conveniently hinged thereto at its lower end. With the door closed the burners or heating elements 16 may be operated to heat the interior of the oven cavity to suitable baking or broiling temperatures. These temperatures may reach up to 500° F or more. It will be apparent that when such oven temperatures are attained, a considerable amount of heat will be transmitted into the door structure and in many cases the exterior surfaces of the door will become unsafely heated.

The door 10 of the present invention overcomes such a problem and comprises spaced thin sheet metal front and rear panels 20 and 22 respectively which are connected together in any suitable manner throughout their peripheries so as to seal the outer edge of the door. The space between the panels 20 and 22 is filled with a suitable insulation 24 of fiber glass wool, or the like.

A window opening 26 is provided through the panels and is defined by a cylinder 28 having a peripheral front flange 30 which is brazed, welded or otherwise fixed to the inner surface of the front panel 20 around the window opening therein. A peripheral rear flange 32 has similarly attached to it a ring 34 which is attached as by screws 36 to connectors 38 fixedly carried by the inner surface of the rear panel 22.

The rear flange 32 itself has a rearwardly directed peripheral flange 40 which abuts the inner surface of the rear panel 22 to form an annular recess in which is fitted the peripheral edge portion of a rear window pane 42 of suitable heat resistant glass, which window thus overlies the rear or inner end of the window opening 26.

Figure 3:
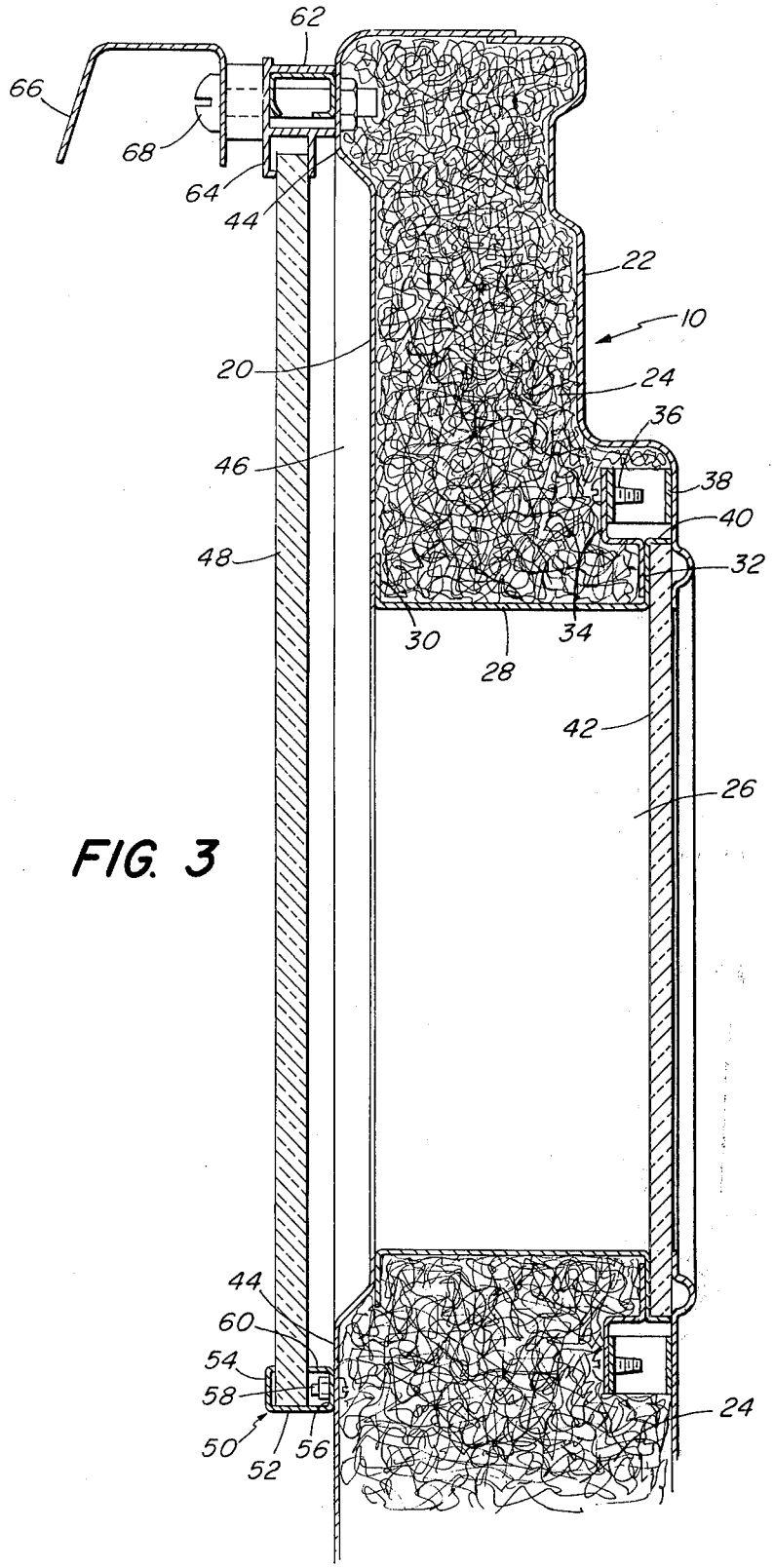
FIG. 3 is an enlarged vertical sectional view through a portion of the oven door embodying the invention.

The front panel 20 is provided with a forwardly protruding or raised portion 44 which extends completely around the forward end of the window opening 26 and is set back from the window opening so as to provide a recess 46 which extends completely around the window opening 26. From FIG. 3, however, it will be seen that the recess 46 in the regions above and at the sides of the window opening 26 extends over a much larger area of the door than at the bottom of the opening.

A front window pane 48 is mounted over the recessed portion of the front panel 20 and covers the window opening 26. In actuality, as shown best in FIG. 3, the pane 48 is spaced outwardly away from the raised portion 44 of the panel by a peripherally extending supporting trim 50. The trim 50 comprises a channel member 52 having a front flange 54 engaging the front of the pane 48 throughout the periphery of the glass, and has a rear flange 56 which engages and is secured to the raised portion 44 of the front panel as by bolts 58. The rear flange 56 is provided with a forwardly projecting portion 60 which engages the rear surface of the glass 48. Thus the glass is disposed outwardly away from the raised portion 44 of the panel 20 by an amount equal to the width of the flange portion 60. This, of course, increases the spacing between the glass and the bottom of the recess 46, thus providing a dead air space between the front and rear panes 48 and 42 which space is considerably augmented by the space between the front pane 48 and the bottom of the recess 46. The trim around the glass 48 effectively seals the glass to the panel and prevents escape of the heat around the edge of the glass.

With such an air space of increased size as described it has been found that when the oven becomes heated during normal operation, the heat which passes through the inner or rear glass 42 will become dissipated or distributed more evenly throughout the enlarged air space and over an enlarged surface area of the outer glass 48. This considerably reduces the hot spots that are usually fund on exterior surfaces of conventional oven doors.

For example, with an oven operating at about 400° F for about one hour, it was found that exterior surfaces will constantly remain at temperatures not greater than about 165° F.

With a window and trim structure as described it has been found convenient at the top of the front panel 20 to alter the shape of the trim so that a hollow bar 62 is provided to which the trim channel portion 64 is attached. One side of the bar 62 abuts the panel surface and the other side is engaged by a handle structure 66, all of which are assembled and attached to the panel by bolts 68, as shown.

The rear glass pane 42 may be provided, if desired, with suitable surface treatment such as a texture or a coating of any suitable heat-reflecting material for reducing the amount of heat which is transmitted into the window opening through the pane 42, as is well known.

From the foregoing it will be apparent that the objectives and advantages of this invention have been achieved by the novel oven door construction described which reduces exterior surface temperatures to safe levels without interference with vision through the window glasses, and without requiring air wash or supplemental cleaning of the glasses.

It will also be apparent that various modifications and changes in the structures shown and described may be made by those skilled in the art without departing from the spirit of the invention as expressed in the accompanying claims. Therefore, all matter shown and described is to be interpreted as illustrative and not in a limiting sense.

What is claimed is:

1. An oven comprising a heating compartment having a door opening therein, at least one heating device within the compartment, and a door located in closing relation to said door opening and having a window opening therethrough, a first transparent pane covering said window opening on the inner side of the door, a second transparent pane covering said window opening and adjacent portion of the outer surface of the door and means for supporting said second pane in spaced relation to the adjacent portion of the outer surface of the door and providing a dead air space therebetween and with said first transparent pane said adjacent portion of the outer surface of the door around the window opening being provided with a continuous recess communicating with the space between the panes, said second pane overlying the entire recess in spaced relation with it the outer surface of the door being provided with a continuous raised portion which extends completely around and outwardly of said recess to define a mounting surface generally parallel to said recess, and said second pane being mounted on said raised portion.

2. An oven as set forth in claim 1 wherein said recess at the sides of and above the window opening is of a width greater than the width thereof beneath the window opening.

3. An oven as set forth in claim 1 wherein trim means extends around the peripheral edge of said second pane, said trim means being in engagement with said raised portion and supporting the second pane in spaced relation with and outwardly of the raised portion and thereby providing an enlarged air space behind the second pane.

4. An oven comprising a heating compartment having a door opening therein, at least one heating device within the compartment, and a door located in closing relation to said door opening, said door comprising spaced outer and inner panels, aligned apertures in the respective outer and inner panels forming a window opening in the door, an inner window pane mounted on the inner panel and covering the aperture therein, an outer window pane mounted on the outside of the outer panel, and means for supporting the outer pane in spaced relation to the adjacent surface of the outer panel and providing a dead air space therebetween and with said inner window pane, said adjacent surface of said outer panel around the aperture therein being provided with a continuous recess communicating with the space between said panes, said outer pane overlying the entire recess in spaced relation with it, said adjacent surface of the outer panel being provided with a cotinuous raised portion which extends completely around and outwardly of said recess to efine a mounting surface generally parallel to said recess, and said outer pane being mounted on said raised portion.

5. An oven as set forth in claim 4 wherein said recess at the sides and above the aperture in th outer panel is of a width greater than the width thereof beneath the aperture.

6. An oven as set forth in claim 4 wherein trim means extends around the peripheral edge of said outer pane, said trim means being in engagement with said raised portion and supporting said outer pane in spaced relation with and outwardly of the raised portion and thereby providing an enlarged air space behind said outer pane.

* * * * *